US010760785B2

(12) United States Patent
Holmes et al.

(10) Patent No.: US 10,760,785 B2
(45) **Date of Patent: *Sep. 1, 2020**

(54) BURNER

(71) Applicant: Metso Minerals Oy, Tampere (FI)

(72) Inventors: Clayton Holmes, Worcestershire (GB); Richard Manning, Hertfordshire (GB); Clifford Rennie, Oxon (GB); Christopher Sansom, Hertfordshire (GB)

(73) Assignee: Metso Minerals Oy, Tampere (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/517,337

(22) PCT Filed: Nov. 5, 2015

(86) PCT No.: PCT/EP2015/075833
§ 371 (c)(1),
(2) Date: Apr. 6, 2017

(87) PCT Pub. No.: WO2016/071457
PCT Pub. Date: May 12, 2016

(65) Prior Publication Data

US 2017/0307213 A1 Oct. 26, 2017

(30) Foreign Application Priority Data

Nov. 7, 2014 (GB) ..... 1419877.4

(51) Int. Cl.
*F23D 14/20* (2006.01)
*F23D 14/22* (2006.01)
(Continued)

(52) U.S. Cl.
CPC ..... *F23D 14/20* (2013.01); *F23D 14/22* (2013.01); *F23D 14/58* (2013.01); *F23D 17/00* (2013.01); *F23D 17/005* (2013.01); *F23D 14/00* (2013.01)

(58) Field of Classification Search
CPC ..... F23D 14/22; F23D 14/24
(Continued)

(56) References Cited

U.S. PATENT DOCUMENTS 2,196,282 A * 4/1940 Voorheis ..... F23D 14/20 431/174
2,303,648 A * 12/1942 Lemster ..... F23C 7/008 239/413
(Continued)

FOREIGN PATENT DOCUMENTS

DE 2 127 474 A1 12/1972
DE 10 2005 053819 A1 5/2007
(Continued)

OTHER PUBLICATIONS

Specification of related U.S. Appl. No. 14/892,258, filed Nov. 19, 2015, PCT International Application No. PCT/EP2014/055743, filed Mar. 21, 2014.

*Primary Examiner* — Avinash A Savani
*Assistant Examiner* — Deepak A Deean
(74) *Attorney, Agent, or Firm* — Andrus Intellectual Property Law, LLP

(57) ABSTRACT

A burner 100 comprising a burner body 110 having a burner chamber with a backing plate 122 and having a burner element received in the burner chamber, the burner element having a plurality of gas nozzles 117 for supplying gas into the burner, the gas nozzles 117 each ending in a tip through which the gas exits and gas nozzle 117, and each gas nozzle being rotatable such that the direction of gas exiting the gas nozzle can be adjusted. The burner has means for rotating
(Continued)

the gas nozzles 117 provided on the backing plate and by releasable means for retaining each gas nozzle 117 in a plurality of rotational configurations provided outside the burner chamber. The gas nozzles 117 further comprise first and second parts which are detachable from each other, the first part comprising the tip and the second part being upstream of the first part with respect to the flow of gas into the gas nozzles in use. The burner allows for tuning of gas flow from outside the burner while it is in use.

11 Claims, 6 Drawing Sheets

(51) Int. Cl.
*F23D 14/58* (2006.01)
*F23D 17/00* (2006.01)
*F23D 14/00* (2006.01)

(58) Field of Classification Search
USPC ..... 431/176, 174
See application file for complete search history.

(56) References Cited

U.S. PATENT DOCUMENTS 2,851,093 A * 9/1958 Zink, Jr. ..... F23D 17/00 431/174
2,931,430 A * 4/1960 Marshall ..... F23D 17/00 239/288.3
3,032,097 A * 5/1962 Marshall ..... F23D 14/20 431/176
3,067,808 A * 12/1962 Poole ..... F23D 17/00 431/176
3,076,496 A * 2/1963 Rackley ..... F23D 11/00 431/174
3,115,851 A * 12/1963 Ceely ..... F23D 17/00 110/261
3,179,152 A * 4/1965 Musat ..... F23D 17/00 431/176
3,476,321 A * 11/1969 Levaux ..... F23D 17/00 239/422
3,822,110 A 7/1974 Paredes et al.
4,223,615 A * 9/1980 Breen ..... F23D 1/02 110/264
4,731,015 A * 3/1988 Johnson ..... F23C 3/002 126/91 A
4,776,289 A * 10/1988 Peter-Hoblyn ..... F23D 1/02 110/264
6,817,140 B1 * 11/2004 Durand ..... A01M 1/023 43/107
10,094,557 B2 * 10/2018 Manning ..... F23D 14/48
2004/0234912 A1 * 11/2004 Sarv ..... F23D 1/00 431/183
2008/0213714 A1 * 9/2008 Knoch ..... F23D 1/00 431/284

FOREIGN PATENT DOCUMENTS

EP 0 340 423 A2 11/1989
EP 0 340 423 A3 11/1989
EP 0 650 012 A1 4/1995
GB 2 310 037 A 8/1997
WO WO 2008/084909 A1 7/2008

* cited by examiner

BURNER

This application is the U.S. national phase of International Application No. PCT/EP2015/075833 filed Nov. 5, 2015 which designated the U.S. and claims priority to British Patent Application No. 1419877.4 filed Nov. 7, 2014, the entire contents of each of which are hereby incorporated by reference.

This invention relates to burners. More especially but not exclusively the invention relates to burners for use in making cement, for lime-burning, for metal reduction or use in lime recovery kilns in paper-making. The invention is not so limited.

GB2310037 describes a range of burners where individual gas nozzles are adjustable. The nozzles in each case are spheres with an axial bore. The nozzles are retained in a tip. In some embodiments the sphere is held in the desired configuration by a grub screw passing through the nozzle and engaging the sphere. In some embodiments the tip terminates in a male screw threaded portion on which is screwed a nut having an inwardly directed flange. Trapped between the end of the pipe and the flange of the nut is a seating cylinder and a nozzle holder. The seating cylinder is provided with a flange which abuts the end of tip. The other end of seating cylinder has a seat for the spherical nozzle. The nozzle holder has an inwardly directed flange such that the nozzle can be trapped between the inwardly directed seat of the nozzle holder. The nozzle holder has, also, an outwardly directed flange by means of which it is trapped between the nut and the tip. By tightening the nut the nozzle can be held in a desired position. By loosening the nut the nozzle can be adjusted. In other embodiments the nozzles are retained by a plate with a plurality of holes in it each hole somewhat smaller than the diameter of the nozzles. The end of the burner is provided with a plurality of holes in which the nozzles are received. The nozzles are trapped between the plate and the end of the burner. A screw threaded fastener passes through the plate and into the body of burner thereby allowing the nozzles to be adjusted and then held in position. This arrangement suffers from several disadvantages. After being used for some time the various screw threaded portions will become difficult to move following exposure to heat, particulate matter and oxidizing conditions. Furthermore the adjustment means are accessible only from within the burner. Accordingly it is only possible to adjust the burner when it is not in use. Additionally it can be difficult accurately to align nozzles. As a result optimisation can become difficult and time consuming.

The invention seeks to provide a burner where individual nozzles, especially gas fuel nozzles are adjustable and the tips thereof are replaceable even while the burner is in use. According to the invention there is provided a burner comprising a burner body having a burner chamber with a backing plate and having a burner element received in the burner chamber, the burner element having a plurality of gas nozzles for supplying gas into the burner, the gas nozzles each ending in a tip through which the gas exits the gas nozzle, and each gas nozzle being independently rotatable such that the direction of gas exiting the gas nozzle can be adjusted, wherein means for rotating the gas nozzles are provided on a backing plate and wherein releasable means for retaining each gas nozzle in a plurality of rotational configurations is provided outside the burner chamber.

The gas nozzles can comprise first and second parts which are detachable from each other, the first part comprising the tip and the second part being upstream of the first part with respect to the flow of gas into the gas nozzles in use. This enables the first part to be detached from the second part, and a new first part attached.

This can be useful for a number of reasons. For example, if a tip gets damaged it can be removed and replaced without having to replace the entire gas nozzle. Further, the ability to change the first part enables nozzles with different tips to be used. This enables a significant degree of further flexibility in the tuning of a burner. For example, each tip generally includes a gas passage through which the gas exits the nozzles at the tip. Different tips may direct the gas exiting the nozzles in different directions, in particular with different angles relative to the axis of the nozzle. Changing a tip then enables a different flow direction of gas to be obtained.

More than one gas passage can be provided on a tip, so a change in flow profile from a gas nozzle can be obtained by changing to a tip with a different number of passages at the exit, Similarly, where there are multiple passages, individual passages can direct portions of the gas exiting the nozzle in different directions, and different tips with multiple gas passages can have configurations of the multiple passages which direct portions of the gas in different configurations to each other.

As a specific example of a difference in angles relative to the axis of a nozzle, each gas nozzle may have a cylindrical cross-section which at the tip is cut at an angle to the cross-section to provide an elliptical face, with a gas passage formed in the face. The shape of the ellipse is defined by the diameter of the cylindrical cross-section and the angle of the cut to the cross-section. Hence different tips which direct gas exiting the gas nozzles at different angles relative to the axis of the nozzle can be obtained by elliptical faces cut at different angles.

Use of a mixture of nozzles with different tips allows a further degree of flexibility in optimising the tuning of the burner.

Each gas nozzle generally extends from the tip and to a position outside of the backing plate of the burner, where it is connected to a gas supply pipe.

The overall length of the gas nozzle can vary widely depending on the application, and in particular the size of the burner. The length of the first part can also vary depending on the application but typically the first part is 50 to 250 mm, for example 100-200 mm, such as 150 mm in length. This provides sufficient distance from the tip to the second part to protect the second part whilst minimising the amount of the nozzle which needs to be changed.

Preferably the first and second parts are connected by a connection means such that different first parts have a defined orientation compared to a second part when connected. An example is the use of a protrusion on the first part which engages with a slot or hole on the second part only when the first and second parts are in the correct orientation. It will be apparent that numerous other techniques for ensuring a defined orientation can be provided, not least the slot or hole being on the first part and the protrusion on the second part, or a combination of slots/holes and protrusions which will allow connection only in a defined orientation.

The use of a connection means which always provides a defined orientation ensures consistent alignment of the gas nozzle with a gas delivery pipe which supplies the gas thereto. It also enables the use of a tell-tale on the second part to indicate the orientation of the first part independently of the first part actually connected. Preferably therefore one or more, and preferably each gas nozzle, is provided with a tell-tale on the second part and visible from outside the burner indicating the rotational position of the nozzle in the burner.

The gas nozzles can preferably be removed individually from the burner whilst the burner is in use. This enables tips/first parts to be replaced without stopping the burner, for example if a tip is damaged or if a different tip is desired for tuning of the burner.

The gas nozzles are preferably each independently rotatable whilst the burner is in use.

The retaining means can be provided on the backing plate.

The gas passed through the gas nozzles in use may be any suitable gaseous fuel (also referred to as inflammable gas). The gas may be natural gas.

The burner can further comprise means for supplying solid fuel to the burner. The burner can further comprise non-rotatable means for supplying gas into the burner.

According to the invention there is further provided a method of burning a gaseous fuel comprising the steps of passing a mixture of inflammable gas and an oxidising agent through a burner of the invention and combusting the mixture.

Further, there is also provided a method of burning a gaseous fuel wherein at least one of the gas nozzles is removed and replaced whilst passing the mixture of inflammable gas and an oxidising agent through the burner and burning the mixture, said replacement nozzle being either an entirely new gas nozzle or being a replacement nozzle obtained by changing the first part of the removed gas nozzle for a new first part.

The replacement nozzle may comprise a different tip to the nozzle removed. Embodiments of the invention will be described by way of non-limiting example by reference to the accompanying figures of which FIG. 1 is a partial perspective view of a burner of the invention in a first configuration FIG. 2 is a partial perspective view of the burner of FIG. 1 in a second configuration FIG. 3 is a partial perspective view of the burner of FIG. 1 in a third configuration FIG. 4 is a partial rear perspective view of the burner of FIG. 1

Figure 1:
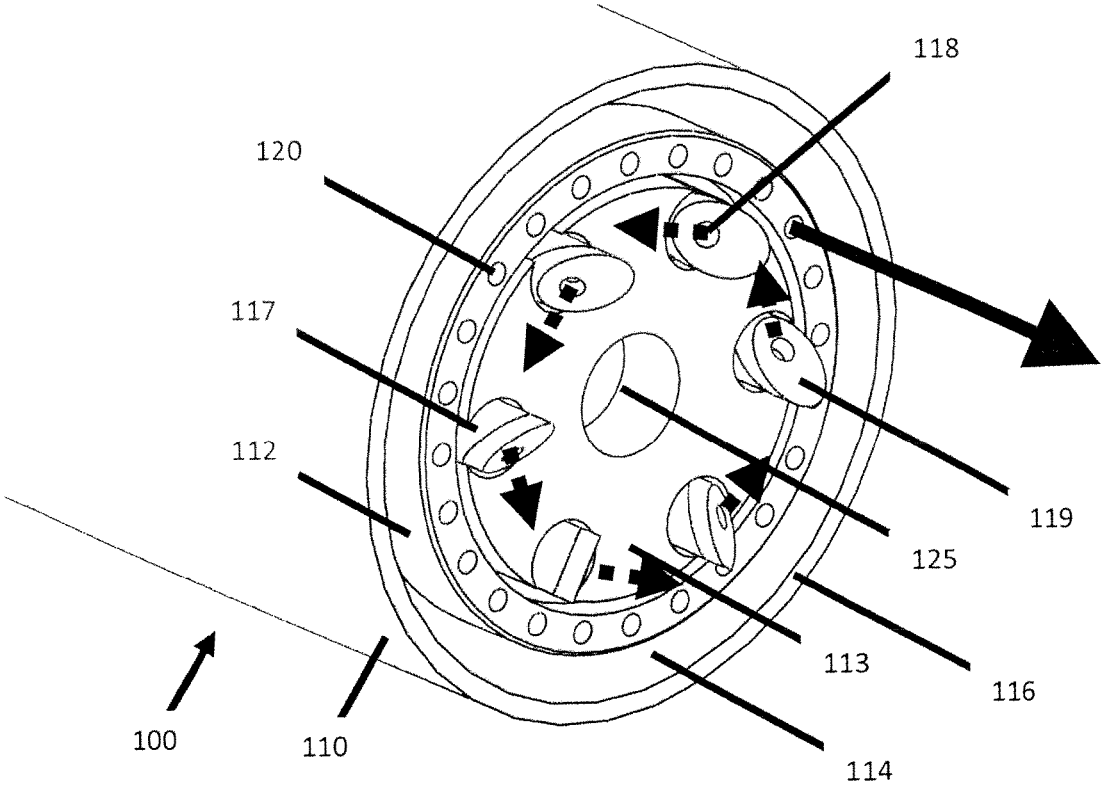

Burner 100 comprises a cylindrical body 110 which forms a chamber. A burner element is received inside the body 110. The burner element may be provided with a right circular cylindrical portion 112 having a circular face 113. A gap 114 is thus defined between the inside of the body and the outside of the element. Preferably this gap is annular but other arrangements such as angular segments can be used. Means for injecting a fuel such as a solid fuel such a powdered pet coke and air into the gap could be provided but this is not essential. The face of the burner element can be provided with a plurality of gas passages 120 which are perpendicular to the circular face 113. These passages may be disposed about the perimeter of an imaginary circle. The above mentioned features allow fuel and air to be expelled from the burner in axial manner.

In accordance with the invention means for providing gas such as fuel gas where the direction of flow of material exiting the burner is adjustable are provided. Hereinafter the expression "adjustable gas" is used in connection with this. In the illustrated embodiment adjustable gas is provided by a plurality of gas nozzles 117. In the illustrated embodiment the gas nozzles are each in the form of a cylindrical section with a gas passage 118 provided in the elliptical face 119 and perpendicular to that face. Those skilled in the art will be able to devise other methods of introducing adjustable gas air such as bent pipes. The precise angle at which the adjustable gas diverges from the angle of axial flow is not of the essence of the invention. Good results can be achieved where the angle is in the range of 20 to 70 degrees for example 30 to 60 degrees more preferably 40 to 50 degrees. In the illustrated embodiment the gas nozzles are equidistantly disposed about an imaginary circle with its centre at the centre of the burner. This is preferred but the gas nozzles need not be equidistantly disposed or disposed about an imaginary circle. In the event they are disposed about an imaginary circle that circle need not have its centre at the centre of the burner. The precise number of gas nozzles is not of the essence of the invention. In the illustrated embodiment 6 are provided but fewer such as 4 or more such as 8 could be used The gas nozzles are rotatable. Preferably the gas nozzles are independently rotatable. Rotation of the gas nozzles enables the non-axial gas flow to be adjusted allowing tuning of the burner. This can be seen by comparing FIGS. 1 to 3 where in FIG. 1 the swirl nozzles are pointed to the side, in FIG. 2 they are pointed to the outside of the burner and in FIG. 3 where they are pointed towards the centre of the burner. It will be apparent to the skilled worker that these variations will have a substantial effect on the disposition of gas in the burner and thus that they allow the burner to be tuned. The skilled worker will of course appreciate that it is not necessary for each gas nozzle to be rotated to the same degree as every other gas nozzle and in many cases there will be differences. Similarly, the tips may not all be the same, for example may not all be of the same angle to the cross-section of the cylindrical body or may have different numbers of passages.

Means for rotating the gas nozzles from outside the burner chamber are provided. Means for retaining the gas nozzles in configuration which are accessible from outside the burner chamber are also provided. Those skilled will have no difficulty in devising suitable means. The means for rotating can simply comprise a portion of the feed pipe to the swirl nozzle outside the burner chamber.

Figure 4:
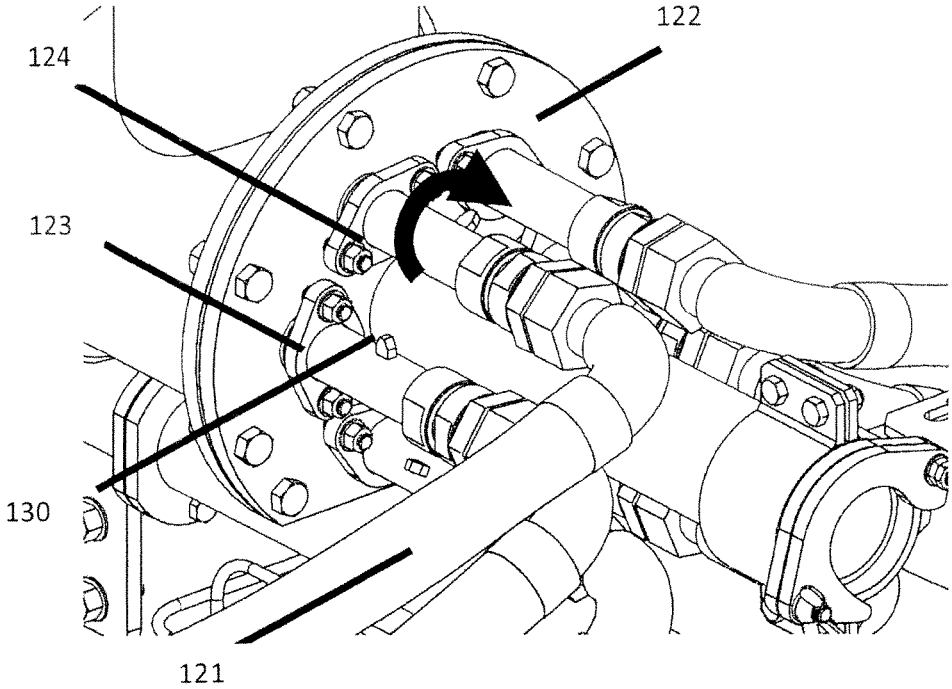

FIG. 4 shows an embodiment. The rear of the burner is defined by backing plate 122. Feed pipes 121 feed gas to the gas nozzle 117 at the backing plate which is to say outside the burner chamber and not exposed to fuel and oxidant or the products of combustion. Typically at least a portion of the feed pipe is flexible or at any rate deformable. Those skilled in the art will have no difficulty suitable materials for the feed pipe. Feed pipe 121 is mounted to gas nozzle to allow gas to be passed through the gas nozzle for example by conventional unions and swivel joints. Rotation of the gas nozzle from outside the burner can thus be achieved by rotating a portion of the gas nozzle outside the burner or by moving the feed pipe or some component to either of these members. Rotation by 360° of each individual nozzle without stopping the flow of gas there through can be obtained, for example, by the use of swivel joints. Desirably but not essentially a tell-tale 130 such as an upstand or indicia can be provided on the gas nozzles to provide information about the orientation of the gas passage of the nozzle.

In some cases suppliers' representatives will tune the burner by manipulating the gas nozzles and once the desired configuration is achieved the swivel joints removed or adjustment means locked to prevent tampering by end-users.

Figure 2:
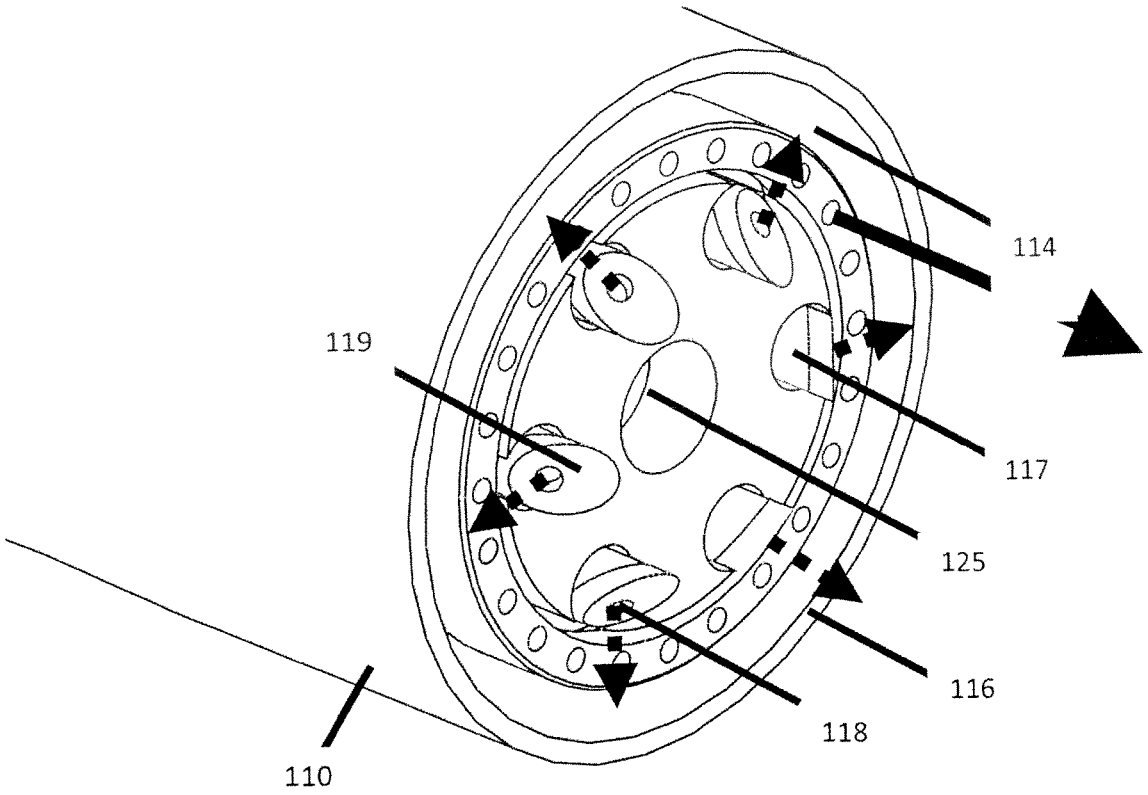
Figure 3:
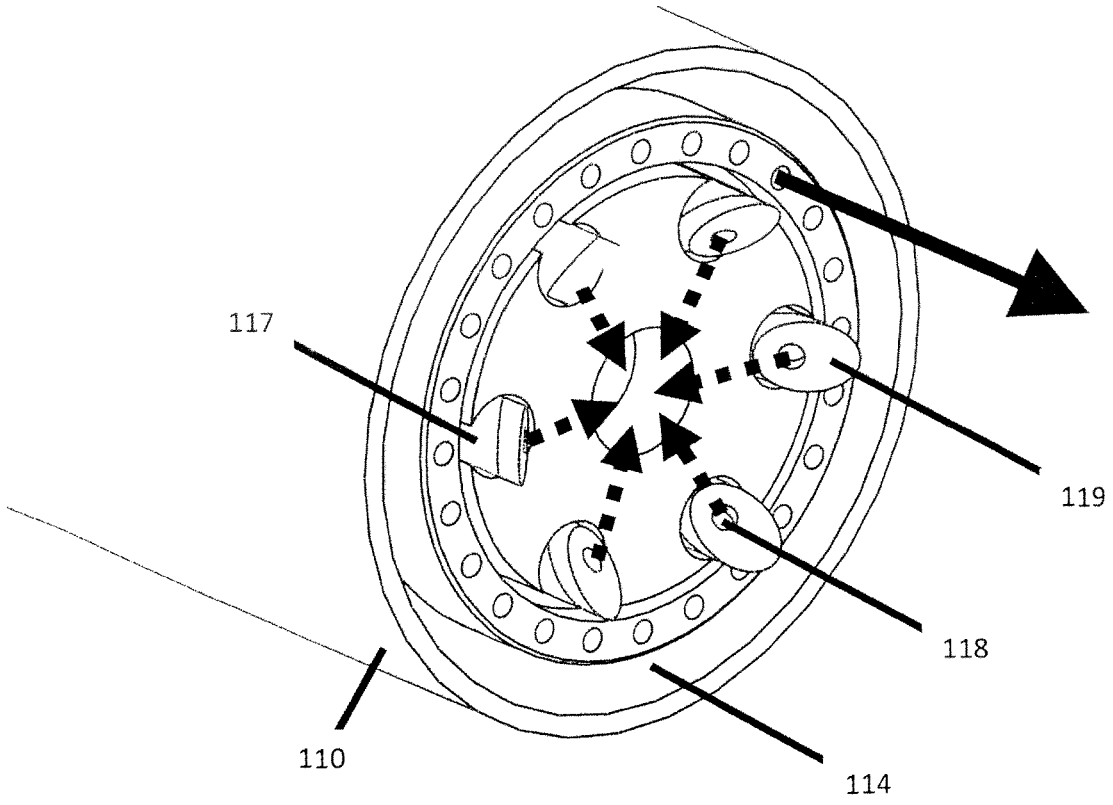

In FIGS. 1 to 3 the tips of the gas nozzles at the end of the first part are visible but not the second part. In FIG. 4 the upstream end of the second part is visible.

Figure 5:
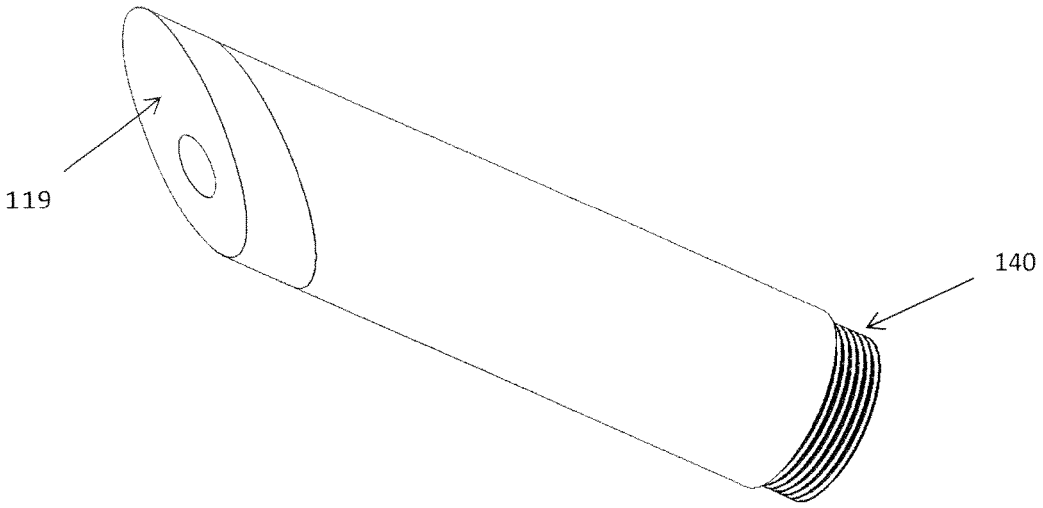
FIG. 5 is a side view of a first part of the gas nozzle.

FIG. 5 shows a side view of the first part of the gas nozzle, showing the face 119 at the tip. At the opposite end of the first part is a male screw thread 140.

Figure 6:
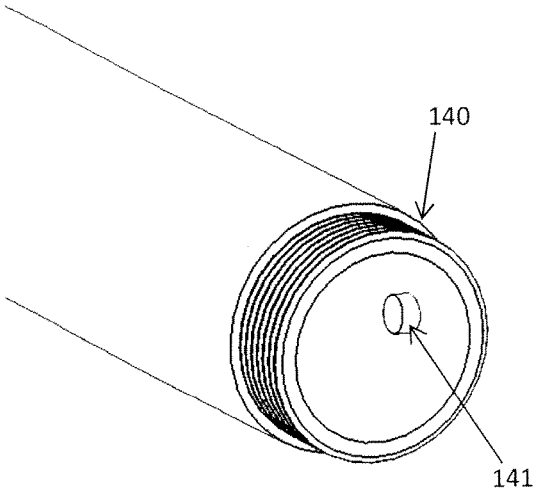
FIG. 6 is a partial perspective view of the first part of FIG. 5

FIG. 6 is a partial perspective view of the end of the first part of the gas nozzle showing the screw thread 140. At this end but inside the first part is a button protrusion 141.

Figure 7:
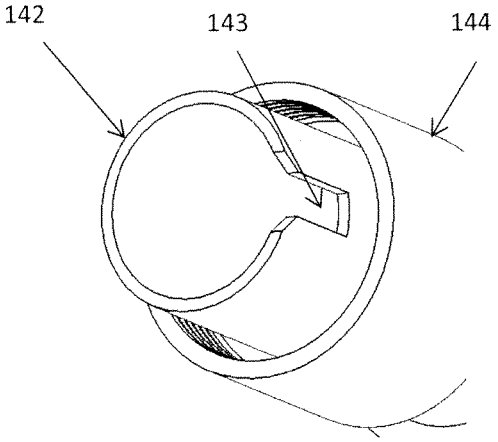
FIG. 7 is a partial perspective view of a second part of the gas nozzle.

FIG. 7 is a partial perspective view of the second part of the gas nozzle, and in particular of the end which attaches to the first part. The second part comprises an inner pipe 142, of a size which can fit closely inside the first part. The pipe has a slot 143 cut in it, the width being just wide enough to allow it to fit around the button protrusion when the first and second parts are connected. This ensures that the first and second parts always connect in a defined orientation relative to each other. The first and second parts are held in place by a collar 144 which screws onto the male screw thread 140.

A gasket or washer can be used to provide a seal between the abutting ends of the first and second parts.

Figure 8:
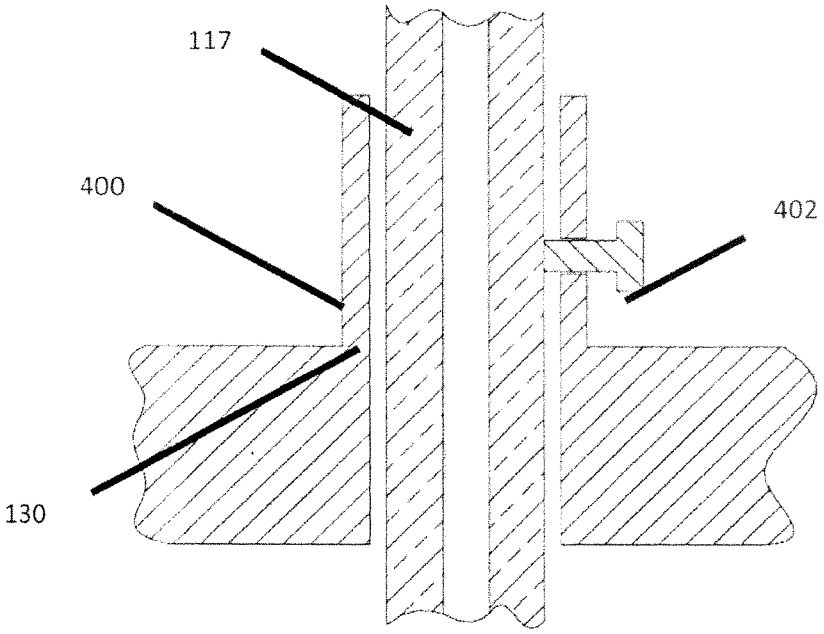
FIG. 8 is a partial cross section of a further burner backing plate and swirl nozzle.

FIG. 8 shows one releasable means for retaining the gas nozzles in position. In FIG. 8 the backing plate 122 can be provided with an upstanding collar 400 surrounding the through bore. One of more screw threaded members 402 can pass through the collar and engage the second part of the gas nozzle 117. In other embodiments a collet arrangement could be used with for example a threaded split collar urged towards the swirl nozzle by a tapered nut.

While in the illustrated embodiments the retaining means are provided at the rear of the burner it is not essential that they are positioned there. They could for example pass through the side wall of the burner.

The invention allows the gas nozzles to be individually adjusted and secured in position while the burner is in operation thereby allowing rapid and efficient burner tuning. It also allows the tips of individual nozzles to be replaced even while the burner is in use, allowing repair of damaged tips or further tuning of the burner.

The invention claimed is:

1. A burner comprising a burner body having a burner chamber with a backing plate and having a burner element received in the burner chamber, the burner element having a plurality of gas nozzles for supplying gaseous fuel into the burner, the gas nozzles each ending in a tip through which the gaseous fuel exits the gas nozzle, and each gas nozzle being rotatable such that the direction of gaseous fuel exiting the gas nozzle can be adjusted, wherein a) the gas nozzles are each independently rotatable whilst the burner is in use, b) a rotatable portion or component configured to rotate the gas nozzles is provided on the backing plate, and c) a releasable configuration for retaining each gas nozzle in a plurality of rotational configurations is provided outside the burner chamber, and further wherein the gas nozzles comprise first and second parts which are detachable from each other such that the first part can be detached from the second part and a new first part attached, the first part comprising the tip and the second part being upstream of the first part with respect to the flow of gas into the gas nozzles in use, wherein said first and second parts are connected by a connection such that the first part has a defined orientation compared to the second part thereby ensuring consistent alignment between the first part and the second part, wherein each gas nozzle is provided with a tell-tale on the second part that is located outside the burner and is visible from outside the burner, which tell-tale indicates the rotational position of the nozzle in the burner.

2. A burner as claimed in claim 1, wherein the connection comprises a protrusion on the first part which engages with a slot or hole on the second part only when the first and second parts are in the correct orientation, or wherein the slot or hole is on the first part and the protrusion on the second part, or a combination of slots/holes and protrusions which will allow connection only in a defined orientation.

3. A burner as claimed in claim 1, wherein the gas nozzles can be removed separately and individually from the burner.

4. A burner as claimed in claim 1, wherein the releasable configuration for retaining each gas nozzle in a plurality of rotational configurations is provided on the backing plate.

5. A burner as claimed in claim 1, wherein each gas nozzle at its tip comprises a cylindrical cross-section having an elliptical face and gas passage is formed in the face.

6. A burner as claimed in claim 1, wherein different gas nozzles present comprise different tips.

7. A burner as claimed in claim 1 further comprising a gap configured to supply solid fuel to the burner.

8. A burner as claimed in claim 1 further comprising a non-rotatable gas passage for supplying gas into the burner.

9. A method of burning a gaseous fuel comprising the steps of passing a mixture of inflammable gas and an oxidising agent through a burner as claimed in claim 1 and burning the mixture.

10. A method of according to claim 9, wherein at least one of the gas nozzles is removed and replaced whilst passing the mixture of inflammable gas and an oxidising agent through the burner and burning the mixture, said replacement nozzle being either an entirely new gas nozzle or being a replacement nozzle obtained by changing the first part of the removed gas nozzle for a new first part.

11. A method according to claim 10, wherein the replacement nozzle comprises a different tip to the nozzle removed.

* * * * *